United States Patent [19]

Chin et al.

[11] Patent Number: 5,057,205

[45] Date of Patent: Oct. 15, 1991

[54] ADDITIVE FOR VANADIUM AND SULFUR OXIDE CAPTURE IN CATALYTIC CRACKING

[75] Inventors: Arthur A. Chin, Cherry Hill; Ajit V. Sapre, W. Berlin; Michael S. Sarli, Haddonfield, all of N.J.

[73] Assignee: Mobil Oil Corporation, Fairfax, Va.

[21] Appl. No.: 204,834

[22] Filed: Jun. 10, 1988

[51] Int. Cl.[5] ..... C10G 11/02

[52] U.S. Cl. ..... 208/121; 208/114; 208/91; 208/52 CT; 208/113; 208/120; 502/68; 502/84; 502/521

[58] Field of Search ..... 208/114, 91, 52 CT, 208/113, 120, 120 MC, 121; 502/68, 84, 521

[56] References Cited

U.S. PATENT DOCUMENTS

| | | |
|---|---|---|
| 4,221,677 | 9/1980 | Vasalos et al. . |
| 4,381,991 | 5/1983 | Bertolacini et al. . |
| 4,465,779 | 8/1984 | Ocalli . |
| 4,469,589 | 9/1984 | Yoo et al. . |
| 4,472,267 | 9/1984 | Yoo et al. . |
| 4,497,902 | 2/1985 | Bertolacini et al. . |
| 4,519,897 | 5/1985 | DeJong . |
| 4,549,958 | 10/1985 | Beck et al. . |

*Primary Examiner*—Helane E. Myers
*Attorney, Agent, or Firm*—Alexander J. McKillop; Charles J. Speciale; Malcolm D. Keen

[57] ABSTRACT

A catalytic cracking process especially useful for the catalytic cracking of high metals content feeds including resids in which the feed is cracked in the presence of a catalyst additive comprising an alkaline earth metal oxide and an alkaline earth metal spinel, preferably a magnesium aluminate spinel which acts as a trap for vanadium as well as an agent for reducing the content of sulfur oxides in the regenerator flue gas. The additive is used in the form of a separate additive from the cracking catalyst particles in order to keep the vanadium away from the cracking catalyst and so preserve the activity of the catalyst; in addition, use of separate additive particles permits the makeup rate for the additive to be varied relative to that of the cracking catalyst in order to deal with variations in the metals and sulfur content of the cracking feed. The additive may be separated from the cracking catalyst by physical classification so that it can be separately withdrawn from the unit for better control of the catalyst/additive ratio. The additive may be injected into the unit separate from the cracking catalyst so that it contacts the feed first to effect a preliminary demetallation.

16 Claims, 2 Drawing Sheets

ADDITIVE FOR VANADIUM AND SULFUR OXIDE CAPTURE IN CATALYTIC CRACKING

FIELD OF THE INVENTION

The present invention relates to a method of reducing sulfur oxide emissions from catalytic cracking operations and, at the same tile, mitigating the deleterious effects of vanadium on catalytic cracking. These objectives are achieved by the use of an additive which acts as a trap for vanadium and sulfur.

BACKGROUND OF THE INVENTION

The catalytic cracking process is widely used in the petroleum refinery industry for the conversion of relatively high boiling point petroleum feedstocks into lower boiling products, especially gasoline. In fact, the catalytic cracking process has become the preeminent process in the industry for this purpose. At present, the fluid catalytic cracking process (FCC) provides the greatest proportion of catalytic cracking capacity in the industry although the moving, gravitating bed process also known as Therxofor Catalytic Cracking (ICC) is also employed. The present invention is primarily applicable to FCC but it may also be employed with ICC.

The increasing necessity faced by the refining industry for processing heavier feedstocks containing higher concentrations of metal contaminants and sulfur presents a number of problems. Sulfur present in the feed tends to be deposited on the catalyst as a component of the coke which is forxed during the cracking operation although most of the sulfur passes out of the reactor with the gaseous and liquid products from which it can later be separated by conventional techniques. It is, however, the sulfur containing coke deposits which form on the catalysts which are a particularly prolific source of problems. When the spent catalyst is oxidatively regenerated in the regenerator, the sulfur which is deposited on the catalyst together with the coke is oxidized and leaves the regenerator in the form of sulfur oxides ($SO_2$ and $SO_3$, generically referred to as $SO_x$) together with other components of the flue gas from the regenerator. Because the emission of sulfur oxides is regarded as objectionable, considerable work has been directed to the reduction of sulfur oxide emissions from the regenerators of catalytic cracking units. One method for doing this employs a metal oxide catalyst additive which is capable of combining with the sulfur oxides in the regeneration zone so that when the circulating catalyst enters the reducing atmosphere of the cracking zone again, the sulfur compounds are released in reduced form so that they are carried out from the unit together with the cracking products from which they are subsequently separated for treatment in a conventional manner. The additive is regenerated in the cracking zone and after being returned to the regenerator is capable of combining with additional quantities of sulfur oxides released during the regeneration. U.S. Pat. No. 3,835,031 describes the use of Group II metal oxides for this purpose; U.S. Pat. No. 4,071,436 describes the use of a catalyst additive comprising separate particles of alumina which functions in a similar way and U.S. Pat. No. 4,071,416 proposes the addition of magnesia and chromia to the alumina containing particles for the same purpose. U.S. Pat. Nos. 4,153,534 and 4,153,535 disclose the use of various metal-containing catalyst additives which are stated to be capable of reducing sulfur oxide emissions with cracking catalyst containing CO oxidation promoters.

The use of magnesium aluminate spinels for the reduction of sulfur oxide emissions is described in U.S. Pat. Nos. 4,469,589 and 4,472,267. The spinel catalyst additive is effective in the presence of conventional CO oxidation promoters such as platinum and in addition, a minor amount of a rare earth metal oxide, preferably cerium, is associated with the spinel.

The presence of metal contaminants in FCC feeds presents another and potentially more serious problem because although sulfur can be converted to gaseous forms which can be readily handled in an FCCU, the metal contaminants are generally nonvolatile and tend to accumulate in the unit. The most common metal contaminants are nickel and vanadium which are generally present in the form of porphyrins or asphaltenes and during the cracking process they are deposited on the catalyst together with the coke forxed during the cracking operation. Because both the metals exhibit dehydrogenation activity, their presence on the catalyst particles tends to proxote dehydrogenation reactions during the cracking sequence and this results in increased amounts of coke and light gases at the expense of gasoline production. It has been shown that increased coke and hydrogen formation is due primarily to nickel deposited on the catalyst whereas vanadium also causes zeolite degradation and activity loss as reported in *Oil and Gas Journal,* 9 Apr. 1984, 102–111. See also *Petroleum Refining, Technology and Economics,* Second Edition, Gary, J. H. et al, Marcel Dekker, Inc., N.Y.., 1984, pp. 106–107. A number of techniques have therefore been proposed to obviate the undesirable effect of these metals.

Because the compounds of these metals cannot, in general, be removed from the cracking unit as volatile compounds the usual approach has been to passivate them or render them innocuous under the conditions which are encountered during the cracking process. One passivation method has been to incorporate additives into the cracking catalyst or separate particles which combine with the metals and therefore act as "traps" or "sinks" so that the active zeolite component is protected. The metal contaminants are removed together with the catalyst withdrawn from the system during its normal operation and fresh metal trap is added together with makeup catalyst so as to effect a continuous withdrawal of the deleterious metal contaminants during operation. Depending upon the level of the harmful metals in the feed to the unit, the amount of additive may be varied relative to the makeup catalyst in order to achieve the desired degree of metals passivation. Additives proposed for this purpose include the alkaline earth metals and rare earths such as lanthanum and cerium compounds as described in U.S. Pat. Nos. 4,465,779; 4,519,897; 4,485,184; 4,549,958; 4,515,683; 4,469,588; 4,432,896; and 4,520,120. These materials which are typically in the oxide form at the temperatures encountered in the regenerator presumably exhibit a high reaction rate with vanadium to yield a stable, complex vanadate species which effectively binds the vanadium and prevents degradation of the active cracking component in the catalyst.

For economic reasons, if for no others, it would be advantageous to use a single additive which is effective for both metals and $SO_x$ removal. Unfortunately, however, there appears to be no correlation between activity as a metals passivator and activity as an $SO_x$ trap.

For example, alumina which is effective as an $SO_x$ trap as described in U.S. 4,071,436, exhibits poor affinity to interact with vanadium. For this reason, it has generally been expected that it would be necessary to use two separate traps in order to handle cracking feeds containing high levels of metals as well as significant quantities of sulfur.

SUMMARY OF THE INVENTION

We have now found a solid additive composition which is highly effective for both metals passivation and $SO_x$ removal during catalytic cracking operations. We have found that a composition comprising a magnesium aluminate spinel together with magnesium oxide is effective not only for $SO_x$ removal but also for vanadium capture; the composition can therefore serve as a dual functional additive for both metals and $SO_x$ removal. The combination of the two materials has been shown to be more effective for vanadium capture than either material on its own. The advantage of this is that if the cracking feed does contain troublesome levels of both sulfur and vanadium, a single additive may be used in amounts lower than would be appropriate if separate additives for metals passivation and $SO_x$ removal were employed. The feeds which may be cracked in the presence of the present additives will typically include 0.1 to 5.0 weight percent sulfur and at least 2 ppmw vanadium, typically greater than 5 ppmw vanadium e.g. 5–100 ppmw vanadium.

According to the present invention, therefore, a catalytic cracking process for catalytically cracking a heavy petroleum cracking feed containing sulfur and vanadium contaminants is carried out in the presence of a minor amount of an additive composition comprising an alkaline earth metal oxide and an alkaline earth metal-containing spinel including an alkaline earth metal and a second metal having a valence higher than that of the alkaline earth metal. The preferred spinels are the magnesium aluminate spinel. A rare earth metal component may also be present in order to catalyze the conversion of $SO_2$ to $SO_3$ in the regenerator and for this purpose lanthanum or cerium oxides are preferred, with lanthanum giving the best effects.

The additive composition is employed as a separate additive to the cracking catalyst, i.e., it is preferably present in the form of particles separate from the particles of the active cracking catalyst, because this is the most effective way of keeping the vanadium away from the active cracking catalyst. It also permits the vanadium/sulfur trap to be added and withdrawn at a rate which is in accordance with the requirements of the feed currently being processed in the unit. This permits the refiner to be responsive to changes and fluctuations in the feedstock as well as to the operating requirements of the unit at any given time which may affect the extent to which vanadium and sulfur exert their harmful effects. Either the active cracking catalyst or the separate metal/$SO_x$ trap particles may include other components encountered in catalytic cracking operations, especially carbon monoxide oxidation promoters such as platinum.

Use of the present vanadium passivating additive composition is advantageous in that the harmful effects of vanadium on the cracking catalyst are inhibited in a very effective manner. The composition has been found to be more effective for this purpose than either of its constituents and, in particular, is better than the oxide alone, especially in terms of hydrogen factor. Use of the present compositions enables catalyst make-up rates to be reduced when operating with vanadium containing feeds.

THE DRAWINGS

In the accompanying drawings FIG. 1 is a simplified diagram of an FCCU with separate injection of metals passivating additive and cracking catalyst.

FIG. 2 is a simplified diagram of an FCCU regenerator equipped for additive/catalyst classification.

DETAILED DESCRIPTION

Figure 1:
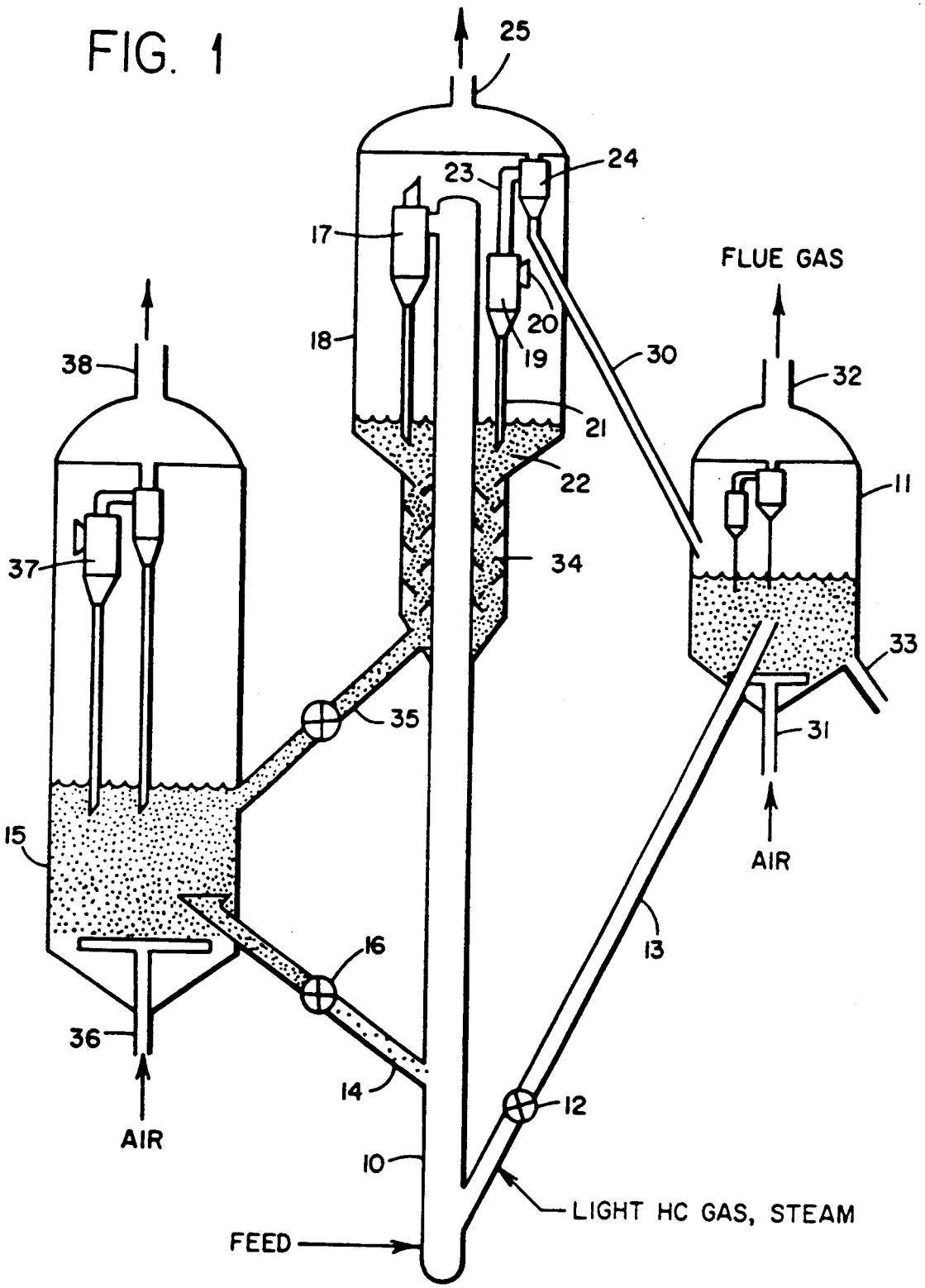

The present invention is employed with catalytic cracking operations in which a high boiling petroleum feed is catalytically cracked to products of relatively lower boiling point, particularly gasoline. The catalytic cracking process is well established and, in general, requires no further description. The use of the present vanadium/sulfur trap may be employed with any catalytic cracking process in which a cracking catalyst is used in a cycle operation in which the catalyst is employed in cyclic cracking and oxidative regenerating step with coke being deposited on the catalyst during the cracking steps and removed oxidatively during the regeneration step. During the regeneration step the oxidation of the coke on the catalyst releases heat which is transferred to the catalyst to raise its temperature to the level required during the endothermic cracking step. Thus, the present vanadium/sulfur traps may be used with both fluid catalytic cracking processes (FCC) and moving, gravitating bed processes (TCC) although they are most readily used with FCC processes for reasons which will be described below. The conditions generally employed in catalytic cracking are well established and may generally be characterized as being of elevated temperature appropriate to an endothermic cracking process with a relatively short contact tile between the catalyst and the cracking feed. Cracking is generally carried out at temperatures in the range of about 850° to 1200° F. (about 450° to about 650° C.), more usually about 900° to 1050° F. (about 480 to 565° C.) under moderate superatmospheric pressure, typically up to about 100 psia (about 700 kPa), frequently up to about 60 psia (about 415 kPa) with catalyst:oil ratios in the range of about 1:2 to about 25:1, typically 3:1 to about 15:1. These conditions will, however, vary according to the feedstock, the character of the catalyst and the desired cracking products slate. During operation, the catalyst passes cyclicly from the cracking zone to a regeneration zone where the coke deposited on the catalyst during the cracking reactions is oxidatively removed by contacting the spent catalyst with a current of oxygen-containing gas so that the coke burns off the catalyst to provide hot, regenerated catalyst which then passes back to the cracking zone where it is contacted with fresh feed together with any recycle for a further cracking cycle.

The cracking catalysts which are used are solid materials having acidic functionality upon which the cracking reactions take place. The pore size of the solids is sufficient to accommodate the molecules of the feed so that cracking may take place on the interior surfaces of the porous catalyst and so that the cracking fragments may leave the catalyst. Generally, the pore size of the active cracking component will be at least 7 angstroms in order to permit the bulky polycyclic alkylaromatic components of a typical cracking feed to enter the interior pore structure of the zeolite. Current catalytic cracking processes employ zeolitic cracking catalysts, usually containing an active cracking component based on synthetic zeolites having a fausasite structure including, for example, zeolite Y, zeolite USY and rare earth exchanged zeolite Y (REY). Conventionally, the zeolite will be distributed through a porous matrix material to provide superior mechanical strength and attrition resistance to the zeolite. Suitable matrix materials include oxides such as silica, alumina and silica-alumina and various clays. Other catalytic components which participate in cracking reactions may also be present, for example, intermediate pore size zeolites such as zeolite ZSM-5 which have been found to be effective for improving the octane number of the gasoline produced during the cracking. Additional zeolites such as ZSM-5 may be present either in the safe catalyst particles as the active cracking catalyst or, alternatively, may be present in separate particles with their own matrix. In FCC operations, it is possible to employ octane improving additives such as ZSM-5 as a separate catalyst additive i.e. on separate particles so as to enable the makeup rate of the cracking catalyst and the octane improver to be separately controlled according to requirements imposed by feed or products slate but in a moving bed (TCC) operation, it will generally be necessary to form a composite of the cracking catalyst and the octane improver in the same catalyst particles or beads since in the large size catalyst beads employed in the moving bed operation, diffusional constraints require the cracking catalyst and the octane improver to be maintained in relatively close proximity for the octane improver to be effective.

Other cracking catalyst additives may also be present either distributed on the particles of the active cracking component e.g. on the matrixed particles of zeolite Y or, alternatively, on separate catalyst particles or on a separate inert support. Additives of this kind may include CO combustion promoters, especially the noble metals such as platinum or palladium as disclosed in U.S. Pat. No. 4,072,600 and 4,093,535. Metals which have been stated to have a desirable effect on the reduction of nitrogen oxide emissions from the regenerator such as iridium or rhodium, as described in U.S. Pat. No. 4,290,878 where the iridium or rhodium is present on the safe particles as the CO oxidation promoter, may also be used. The use of palladium and ruthenium for promoting CO combusion without causing the formation of excessive amount of nitrogen oxides is described in U.S. Pat. Nos. 4,300,947 and 4,350,615. The use of other systems and additives for proxoting CO oxidation in in the regenerator is described in U.S. Pat. Nos. 2,647,860, 3,364,136, 3,788,977, and 3,808,121. Such additives and systems may be used in conjunction with the present spinels with the additional additives distributed on the particles of the cracking catalyst or on separate additive particles.

The additive according to the present invention comprises an effective amount of at least one alkaline earth metal oxide, preferably magnesium oxide in combination with at least one alkaline earth metal-containing spinel which is present in particles separate from the active cracking particles so as to permit the makeup rate of the additive to be varied according to the requirements of the feedstock and unit operational constraints and to provide the best vanadium passivation. The presence of both the oxide and the spinel has been found to be necessary for satisfactory vanadium capture; either material on its own is far less satisfactory.

The alkaline earth metal-containing spinels which may be used in the present cracking process are disclosed in U.S. Pat. Nos. 4,469,589 and 4,472,267, to which reference is made for a description of those materials, their preparation and properties and their use in catalytic cracking operations. Reference is especially made to U.S. 4,469,589, column 7, line 36 to column 10, line 10.

The preferred materials for use in the present compositions are the magnesium aluminate spinels which, in combination with the oxide, have been found to be very successful for vanadium capture as well as for the removal of sulfur oxides from regenerator flue gas. As shown below, the combination of the spinel with the oxide is particularly effective in this respect, being more active for vanadium immobilization than silicates such as talc, titanates and comparable to that of magnesium oxide which, although it is highly effective for the removal of $SO_x$ from regenerator flue gas, has a relatively poor ability to release the sulfur as $H_2S$ in the reducing atmosphere of the FCC riser. The spinel/oxide combination, however, is superior in this respect and also affords high activity retention, excellent gasoline selectivity and low hydrogen and coke selectivity.

It is preferred that the particles which contain the spinel should also contain a catalyst which is effective for promoting the conversion of sulfur dioxide to sulfur trioxide under the conditions prevailing in the regenerator. A suitable promoter for this purpose is a metal or a compound of a metal of Group VI, IIB, IVB, VIA, VIB, VIIA or VIII of the Periodic Table (or mixtures of these metals or compounds), of which the preferred promoters are the rare earth metal oxides, especially lanthanum or cerium oxide. The cerium or other rare earth compounds may be associated with the spinels using any suitable technique such as impregnation, coprecipitation or ion exchange, as described in U.S. Pat. No. 4,472,267 to which reference is made for a description of the manner in which these oxides may be used in conjunction with the spinels for the purpose of promoting oxidation of sulfur dioxide in the regenerator. Generally, the amount of rare earth compound will be from 0.05 to 25 weight percent, preferably 0.1 to 15 weight percent, and in most cases from 1.0 to 15 weight percent rare earth, calculated as elementary metal, based on the weight of the particles containing the spinel.

The amount of the additive combination used in the circulating catalyst inventory is related to the content of both the vanadium and of the sulfur in the FCC feed. Thus, as the content of vanadium increases, the amount of the oxide/spinel combination circulating in the catalyst inventory is increased accordingly in order to trap the vanadium effectively; similarly, as the amount of sulfur in the FCC feed increases, the amount of the additive combination should be increased in order to maintain the $SO_x$ emissions from the regenerator stack within the requisite limits. However, because the additive acts as a trap for both vanadium and as a sulfur oxides emission regulator, it is not necessary that the amount of additive should be related to the sum of the vanadium and sulfur contents in the feed. Rather, the amount of additive circulating in the catalyst inventory should be adjusted according to the higher control requirement, be it the sulfur or the vanadium. Thus, if the feed contains relatively high amounts of sulfur and relatively low amounts of vanadium, the amount of additive should accord with the sulfur content of the feed and conversely, if the feed is relatively high in vanadium and low in sulfur, the amount of additive should be adjusted in order to passivate the vanadium effectively. By using the additive as a trap for vanadium as well as to control sulfur emissions from the regenerator, the makeup rate for the active cracking catalyst is effectively reduced since the vanadium is retained on the particles of the additive so that it cannot exert its deactivating effect on the cracking component. At the same time, gasoline selectivity will be improved and selectivity to hydrogen, dry gas and coke will also improve and sulfur emissions from the stack will be reduced.

The ratio between the oxide and the spinel in the additive composition may vary, typically from 90:10 to 10:90 (by weight), but is preferably from 70:30 to 30:70, with about 50:50 being preferred. The total amount of additive components (oxide, spinel) relative to the cracking component will, as described above, be adjusted according to the vanadium and sulfur contents of the feed. Typically, the additive will comprise at least 1 weight percent of the circulating inventory and generally will not exceed 25 weight percent of it. Normally the amount of additive will be from about 5 to about 20 weight percent of the total circulating inventory.

The oxide and the spinel, together with any other components desired in the additive composition, for example, rare earth oxides, may be formulated into a particulate additive composition with a particle size appropriate for fluid catalytic cracking purposes by conventional techniques. A binder such as silica, silica-alumina, alumina or a clay may be used and established fluid catalyst manufacturing techniques e.g. slurrying with binder and water followed by spray drying, are suitably employed.

The use of a vanadium trapping additive in the form of separate particles is desirable because not only does the capture of the vanadium on the particles separate from the active cracking component or other active zeolite component keep the vanadium away from the zeolite so as to mitigate the destructive effect of the zeolite but, in addition, catalyst and additive management is facilitated because the vanadium passivating additive can be added at greater or lesser rates depending upon the vanadium content of the feed. Thus, the composition of the circulating inventory of catalyst and additive can be varied by varying the relative makeup rates of the cracking catalyst and the additive. Control of the addition rate of the vanadium passivating additive therefore provides one method for controlling circulatory inventory composition. However, control of the addition rate may not be sufficient on its own to control the composition of the circulatory inventory in all circumstances. For example, if the vanadium passivating additive is particularly attrition resistant (compared to the particles of the active cracking component), the cracking particles will tend to be removed from the inventory as fines more quickly than the additive so that additive concentration will increase. Alternatively, if the vanadium passivating additive becomes quickly deactivated by high metals contents in the feed, the high additive addition rate coupled with the slower withdrawal rate resulting from the withdrawal of the averaged composition inventory, results in an increase in additive levels in the circulatory inventory. Because the additive will typically possess poorer cracking selectivities than the active cracking component, high additive concentrations may have a negative effect on cracking yields and selectivities. It is therefore desirable to provide sole way of withdrawing the vanadium passivating additive selectively from the circulatory inventory. Although complete separation may not be achieved, separation of the bulk i.e. the major portion, of the additive from the bulk of the cracking catalyst is desirable.

One way in which this can be done is to employ the vanadium passivating additive in the form of separate particles i.e. separate from the particles with the active cracking component which have a different physical property from the cracking particles so that a physical separation or classification can be made. Particle density offers a potential for classification and provided suitable measures are taken to ensure that the metals passivating additive circulates with the cracking component during the cracking portion of the cycle, may be used to separate the additive from the cracking component. Density differences between the cracking catalyst and the additive should, however, not be permitted to result in additive accumulations in the regenerator as the cracking component would then be unprotected during the cracking part of the cycle. The use of additive particles which are less dense than the cracking catalyst particles therefore offers a potential for selective withdrawal, usually without the necessity for equipment modification because if the additive particles are less dense than the catalyst they will circulate with it but they can still be separated and withdrawn. The use of different particle sizes also offers a potential for separate additive withdrawal since the circulating catalyst inventory can be withdrawn and classified and the additive separated from the cracking particles after which the cracking particles can be wholly or partly returned to the circulatory inventory depending on the desired makeup or withdrawal rate. Although, for the purpose of classification, the additive is required to be separate from the cracking catalyst it may have other additive components in it or on it, especially the sulfur dioxide oxidation promoters such as lanthanum or cerium oxide, as long as they do not affect the physical property explained in the classification.

The use of additive particles which are of a significantly smaller particle size than the particles containing the active cracking catalyst represents a particularly favorable way of separating the additive particles from the cracking catalyst particles. FCC cracking catalysts typically have a particle size from about 50–300 microns, usually about 50–100 microns (typical average is 60–75 microns) and if the vanadium passivating additive is made with a significantly smaller particle size it can be separated by the fine particle separation techniques described in U.S. Pat. applications Ser. Nos. 667,660 and 667,661, both filed 2 Nos. 1986 (Mobil Cases 3052, 3054) to which reference is made. For this purpose the additive should be made with a particle size which is small enough to permit separation by those techniques: a particle size of 10 to 25 microns is suitable for this purpose. When the fines withdrawal is operated according to those techniques, the additive will be withdrawn together with the cracking catalyst fines and then, by adjusting the makeup rates of cracking catalyst and additive, the desired composition of the circulatory inventory will be achieved more quickly than if makeup rate is the sole controllable variable.

The fines withdrawal technique described in Ser. Nos. 667,660 and 667,661, briefly and specifically stated, requires a withdrawal of catalyst from a dipleg in the secondary cyclone of the regenerator with diversion of the withdrawn catalyst to an external hopper. When applied to the present catalyst/additive system, the withdrawn fines would comprise cracking catalyst fines produced by attrition together with the additive particles together with additive fines produced by attrition so that passivated vanadium would be continuously withdrawn from the unit.

Another classification method by which small sized particles of vanadium passivator could be removed from cracking catalyst particles of large size is disclosed in U.S Pat. No. 4,515,903. Another technique is described in application Ser. No. 938,097 filed 4 Dec. 1986 (Mobil Case 3781).

As an alternative to using relatively smaller sized particles of the additive, large sized particles could be used provided that in an FCC process they were still fluidisable so that they would circulate with the cracking catalyst particles. Withdrawal of a stream of the circulatory inventory would then permit separation by air classification with return of the cracking catalyst to the unit. The use of smaller size particles for the passivator will, however, be preferred because the smaller particles provide a relatively greater surface area and in diffusion limited processes they have high effectiveness factors. As shown in U.S. Pat. No. 4,515,903, smaller particles will generally make better metals traps.

Because the vanadium passivator is principally intended to protect the active zeolite cracking component of the catalyst from the effects of the vanadium, the passivator will work best if the feed comes into contact with the vanadium passivator particles before the cracking catalyst particles so that at least sole of the vanadium will be bound before reaching the zeolite cracking component. Although the process of vanadium passivation may not be completed until the passivator enters the regenerator where reaction between the metal oxide passivator and the vanadium proceeds to form the stable vanadate anion, the initial contact between the passivator and the feed effects a preliminary demetallation together with removal of sole sulfur, nitrogen and CCR coke so that the cracking process will take place under more favorable conditions. This is particularly so with heavy resid feeds which contain high CCR and Ramsbottom coke precursors as well as high levels of vanadium, sulfur and possibly nitrogen.

According to this technique, therefore, the metal trap or passivator is contacted with the cracking feed prior to the cracking catalyst. In the conventional FCC riser cracking operation, therefore, the feed will be brought into contact with the additive particles at the lower end of the cracking riser with the regenerated cracking catalyst particles being introduced further up the riser. The additive and the cracking catalyst are separated from each other during each cycle in this type of operation so that they can be separately brought into contact with the feed. The separation may take place either in the reactor or the regenerator using physical differences between the particles to effect the separation. Alternatively, a stream of the circulatory inventory may be withdrawn and classified to provide sufficient additive, after which the cracking catalyst can be returned to inventory. For this purpose, density differences between the particles provide the best means for the continuous separation which is required.

FIG. 1 shows, in simplified form, an FCCU which provides for separate addition of the additive and the feed to the cracking riser. The cracking feed together with steam for improved mixing is fed into the base of riser 10 where it coxes into contact with hot vanadium passivating additive from additive regenerator 11. Control valve 12 in regenerated additive conduit 13 regulates the rate of flow of the additive to the base of the riser according to operational factors such as feed rate and feed composition. As the feed comes into contact with the hot additive, the feed is partly vaporised and metal contaminants, especially vanadium, CCR coke and basic nitrogen compounds will tend to deposit preferentially on the surface of the passivator particles. Further up the riser, hot, regenerated cracking catalyst enters through conduit 14 from regenerator 15 with control valve 16 providing control of the rate. Because the feed has been dexetallised and reduced in CCR content by the preliminary contact with the hot additive particles, the cracking performance is significantly enhanced. The reduction of CCR by the split flow to the riser will be of particular benefit in heavy oil and resid cracking since the high CCR levels in these feeds make a significant contribution to the total coke yield. The cracking catalyst therefore operates on a reduced CCR feed with consequent improvements in product yields and selectivities.

The vaporous cracking product are disengaged from the solid additive and catalyst particles at the top of the riser by conventional means such as riser cyclone 17 at the top of riser 10 or by other devices such as side riser exits, down-turned riser tops etc. Separation is then completed in the large volume reactor 18 which surrounds the top of riser 10. The term "reactor" is now a misnomer since most of the cracking takes place in the riser; indeed, it is desired to minimise catalytic and thermal cracking in the "reactor" because both are less selective than the cracking which takes place on the fresh, hot catalyst in the riser. The reactor therefore serves mainly to complete vapor/solid disengagement but the term "reactor" has persisted for historical reasons.

Separation of the additive from the cracking catalyst takes place in a primary reactor cyclone 19 which receives a dilute phase of catalyst/additive in vaporous cracking products through inlet 20. Cyclone 19 provides a partial separation of cracking catalyst and additive particles: the cracking catalyst particles are of greater size and separate readily with the cracking catalyst particles returning through dipleg 21 to the dense bed 22 of catalyst at the bottom of the reactor. A dilute phase of passivator additive particles passes through conduit 23 to a secondary reactor cyclone 24 where the additive particles together with entrained catalyst fines are separated from the cracking product vapors which leave the reactor through conduit 25. Separated additive particles leave cyclone 24 through dipleg 30 to return to regenerator 11 where the coke is burned off in the conventional manner by means of a current of oxygen-containing gas, preferably air, blown into the bottom of the regenerator vessel through inlet 31. Regenerator flue gas leaves through the regenerator cyclones and finally through stack 32. Additive particles can be withdrawn from additive regenerator 11 through withdrawal conduit 33 at a rate dependent on feed rate, feed composition and additive deactivation rate.

Although the separation between the cracking catalyst and the additive in the cyclones will not be complete—in particular, catalyst fines will get carried over with the smaller additive particles—the separation between them does not need to be complete. All that is required is that the separation be sufficient to provide an additive-enriched stream which contacts the feed before the catalyst-enriched stream so as to promote the desired demetallation together with the associated reductions in CCR, sulfur and nitrogen. Thus, the presence of a proportion of catalyst fines in the additive will not negate this advantage, neither will the pressure of additive particles in the catalyst entering the riser through conduit 14 since demetallation may proceed up the riser.

The catalyst is regenerated separately in the conventional manner in catalyst regenerator 15 with the catalyst flowing from the dense bed 22 in the reactor through steam stripper 34 and spent catalyst conduit 35. Regenerator 15 is provided with air inlet 36, cyclones 37 and stack 38 in the conventional manner. The regenerator shown is the customary high inventory, dense/-dilute phase regenerator but other types may also be used for this and the additive regenerator, for example, the combustor type regenerator shown in U.S. Pat. No. 3,926,778. However, for certain purposes the high inventory regenerator may be preferred since it may be used to separate the catalyst and additive particles, as described below.

With this type of operation, the increased effectiveness of the smaller additive particles for metals passivation is a particular advantage but other advantages also accrue. First, the coke deposited on the spent cracking catalyst and its metals content is markedly reduced so that regeneration conditions are much milder and less catalyst deactivation occurs. Furthermore, as the additive partially vaporizes the hydrocarbon feed, the heat requirement from the catalyst is also reduced. In the second additive regenerator, the coke is burned off the trapping material and sent back to the riser and the elimination of zeolite degradation concerns here allows very high temperatures to be employed so that in spite of the reduced heat requirement for the cracking catalyst the appropriate heat balance can be maintained.

The use of two regenerators permits separate addition and withdrawal policies for the catalyst and metals trap. Therefore, the refiner can be very responsive to feedstock changes and fluctuations. This added flexibility is especially apparent when switching from a high metal-containing charge to a lesser one. Without direct control over the withdrawal rate of the additive, a significant amount of time would be needed.

Figure 2:
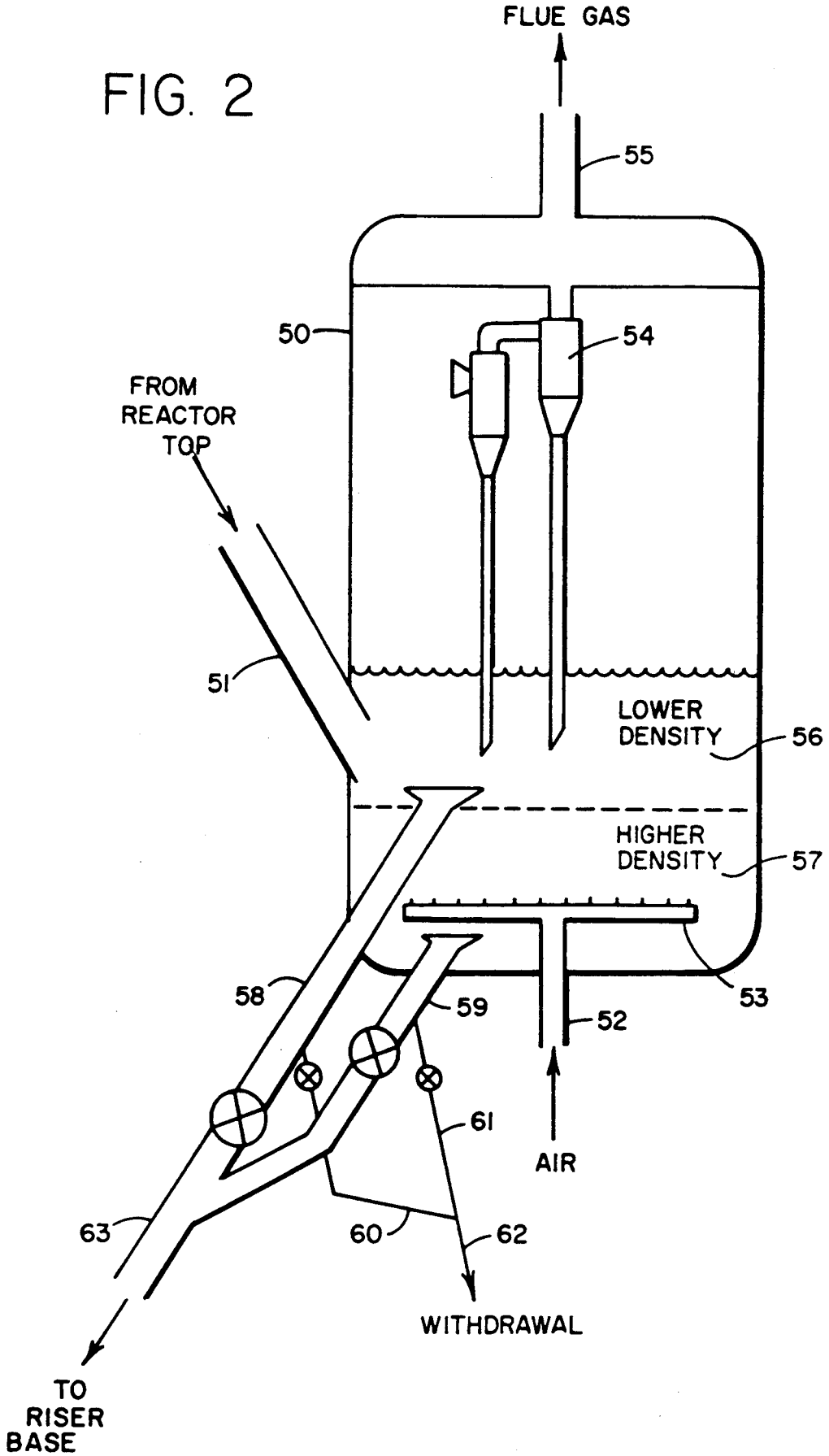

The additive particles can be separated from the cracking catalyst particles as described above, by a classification technique based on density differentials. A regenerator for concurrently regenerating the catalyst and the additive and for classifying the catalyst/additive mixture is shown in FIG. 2. A mixture of catalyst and additive particles from an FCC reactor similar to that shown in FIG. 1 but without a catalyst/additive classifier is introduced into regenerator 50 through inlet 51 which enters the regenerator vessel tangentially to impart a swirling motion to the solids in the regenerator. For this reason the regenerator is referred to as a swirl regenerator. Air is admitted to the regenerator vessels through inlet 52 and distributed evenly across the vessel by distributor grid 53. The coke on the catalyst and additive particles is burned off the particles in the normal way as the particles continue in their swirling pattern around the regenerator. Regenerator flue gases are separated from solid particles of catalyst and additive in cyclones 54 and flue gases leave through stack 55.

Differences in particle density will lead to an upper zone 56 of relatively low density and a lower zone 57 of relatively high density. Depending on the choice and preparation technique of the solid additive, it may tend to concentrate in either zone. Particles are withdrawn from upper zone 56 by outlet conduit 58 and from lower zone 57 by outlet conduit 59. The separated particles (catalyst and additive) may be withdrawn at selected different rates through withdrawal conduits 60, 61 which may then be combined in a common withdrawal outlet 62 for disposal. The separated particles may be re-combined downstream of the withdrawal conduits for recirculation of the catalyst/additive mixture to the cracking riser through a common conduit 63, as shown or, alternatively the separated particles may be introduced at different levels in the riser so that the additive particles contact the feed first, as shown in FIG. 1.

Separation of the catalyst from the passivator additive is desirable not only because it permits separate control of the circulatory catalyst and additive inventories but also because it permits the two materials to be treated separately during the cracking/regeneration cycle. For example, as described above, the cracking catalyst containing the more temperature sensitive zeolite can be regenerated at a lower temperature than usual but an appropriate heat balance can be maintained by regenerating the additive at a higher temperature. Another possibility would be represented by the use of other metals passivation techniques. For instance, treatment of the catalyst by reducing gases such as light hydrocarbons, steam or $H_2S$ has been reported to decrease the dehydrogenation activity of metals. Reference is made to U.S. Pat. Nos. 4,377,470, 4,382,015, 4,404,090 4,409,093, 4,435,279 and 4,479,870 for details of such techniques. These gases may be introduced into the additive circulation at a point where the catalyst is separated from the additive, for example, in the regenerated additive conduit leading from the regenerator to the cracking riser (FIG. 1, conduit 13; FIG. 2, conduit 58 or 59). In order to prevent backflow of gas into the regenerator, the treatment gases should be introduced below the control valve (FIG. 1,2). Because the metals are concentrated on the trap, more effective use of the gases is provided. The possibility that the reducing gas treatment may adversely affect the performance of the cracking catalyst is also eliminated in this way. Contact with the reducing gas should take place after the additive particles have been regenerated since they are then clean and free of coke.

The metals passivator and the cracking catalyst may each be fed into the riser at more than one point, at different vertically separated levels.

The techniques for the separation of the vanadium passivator from the cracking catalyst and for the separate injection of the additive and the catalyst into the riser are applicable not only with the spinel vanadium trap materials described above but also with any solid additive or adsorbent where there is an advantage either from contacting the cracking feed with the additive or adsorbent before the catalyst metals passivating or from maintaining a closer control on the composition of the circulatory inventory in the unit. Thus, these techniques may be used with other additives such as the alkaline earth metal and rare earth metal compounds referred to above as well as with sulfur oxide adsorbents and other materials.

EXAMPLE 1

The effect of various additives on catalytic cracking was investigated using a laboratory scale fixed fluidized bed cracker. A standard cracking catalyst based on zeolite REY in a $SiO_2$/clay matrix (29.2 wt. pct. $Al_2O_3$, 3.3 wt. pct. $RE_2O_3$, 3700 ppm Na, Davison RC25-trademark) was used with a 455°-687° F. (235°-365° C.) Light East Texas gas oil feed (0.13 wt. pct. S, 300 ppm N [total], 45 ppm N [basic], 0.1 wt. pct. Ni, 0.1 ppm V, 0.77 ppm Fe, 0.05 ppm Cu). The cracker was operated at 850° F. using a catalyst/oil ratio of 2:1 with 5 minutes on-stream time.

Various additives were added to the catalyst inventory in a ratio of 85:15 (catalyst:additive). Vanadium was added as $V_2O_5$ powder in an amount equivalent to 6000 ppmw vanadium (as metal) based on the weight of the catalyst blend. The mixture was then steamed at 1450° F. for 10 hours in a 45/55 steam/air mixture at 1 atmosphere pressure. This procedure simulates vanadium deactivation of FCC catalysts under commercial conditions. The cracking characteristics were determined by measuring the conversion and the amounts of the gasoline and coke products which are shown in Table 1 below. The derived values of UOP Dynamic Activity and hydrogen factor were determined as follows.

$$\text{UOP Dynamic Activity} = \frac{\text{Conversion}/(100 - \text{Conversion})}{\text{Coke}}$$

$$H_2\ \text{Factor} = \frac{H_2}{C_1 + C_2 + C_2^{=}} \times 100\ \text{(volume basis)}$$

The UOP Dynamic Activity is descirbed in *Oil and Gas Journal* 26 June 19876, pages 73-77 and provide s a measure of coke selectivity at a given level of coke. The results obtained are set outing Table 1.

TABLE 1

Cracking Characteristics of V-Containing Catalyst/Trap Mixtures

| Additive | Conv (vol) | Gaso (vol) | Coke (wt) | $M_2$ | UOP Dynam. | $H_2$ Factor |
|---|---|---|---|---|---|---|
| Base w/o V | 81.8 | 63.3 | 2.80 | 0.04 | 1.61 | 25.8 |
| None | 56.4 | 47.2 | 1.26 | 0.05 | 1.03 | 63.8 |
| Talc | 57.7 | 48.2 | 1.15 | 0.06 | 1.19 | 67.0 |
| $MgTiO_3$ | 62.0 | 48.4 | 2.06 | 0.07 | 0.79 | 81.1 |
| MgO | 74.5 | 59.3 | 2.30 | 0.06 | 1.27 | 58.4 |
| $MgO/MgAl_2O_4$* | 72.5 | 59.8 | 2.04 | 0.04 | 1.29 | 37.9 |
| $CeO_2$ | 65.6 | 53.6 | 1.43 | 0.06 | 1.33 | 61.8 |
| $Al_2O_3$ | 42.9 | 35.8 | 0.49 | 0.07 | 1.53 | 121.5 |

Note
*50:50 (wt/wt) mixture of MgO and magnesium aluminate spinel.

We claim:

1. In a fluid catalytic cracking process in which a hydrocarbon feedstock containing a vanadium contaminant in an amount of at least 2 ppmw is cracked under fluid catalytic cracking conditions with a solid, particulate cracking catalyst to produce cracking products of lower molecular weight while depositing carbonaceous material on the particles of cracking catalyst, separating the particles of cracking catalyst from the cracking products in the disengaging zone and oxidatively regenerating the cracking catalyst by burning off the deposited carbonaceous material in a regeneration zone, the improvement comprising reducing the make-up rate of the cracking catalyst by contacting the cracking feed with a particulate additive composition for passivating the vanadium content of the feed, comprising an alkaline earth metal oxide and an alkaline earth metal spinel.

2. A fluid catalytic cracking process for the conversion of a high boiling hydrocarbon feedstock containing sulfur and vanadium contaminant in an amount of at least 2 ppmw by circulating a fluid cracking catalyst in a cracking zone, a disengaging zone and a regeneration zone, contacting the cracking feedstock with a solid, particulat additive composition for passivating the vanadium constant of the feed, comprising an alkaline earth metal oxide and an alkaline earth metal spinel, contacting the feedstock in the cracking zone under catalytic cracking conditions with a solid, particulate cracking catalyst to produce cracking products of lower molecular weight while depositing carbonaceouds material on the particles of cracking catalyst, separating the particles of cracking catalyst from the cracking products in the disengaging zone and oxidatively regenerating he cracking catalyst by burning off the deposited carbonaceous material in a regeneration zone, the particles of the additive composition having a physical property differing from that the of the particles of the cracking catalyst permitting physical separation of the additive composition particles from the cracking catalyst particles, the additive composition particles being separated for the cracking catalyst particles during the circulation of the catalyst.

3. A process according to claim 2 in which the additive particles are smaller than the cracking catalyst particles and are separated from the major portion of the cracking catalyst particles by size classification.

4. A process according to claim 3 in which the separated additive particles are withdrawn from the unit in which the process is being conducted together with cracking catalyst fines.

5. A process according to claim 3 in which the size classification is effected in a cyclone in the regeneration zone.

6. A process according to claim 3 in which the additive particles have an average particle size of no more the 40 microns.

7. A fluid catalytic cracking process for the conversion of a high boiling hydrocarbon feedstock containing sulfur and vanadium contaminant by circulating a fluid cracking catalyst in a cracking zone, a disengaging zone and a regeneration zone, contacting the feedstock in the cracking zone under catalytic cracking conditions with a solid, particular cracking catalyst to produce cracking products of lower molecular weight while depositing carbonaceous material of the particles of cracking catalyst, separating the particles of cracking catalyst from the cracking products in the disengaging zone and oxidatively regenerating the cracking catalyst by burning off the deposited carbonaceous material in a regeneration zone, in which the cracking is carried out in the presence of solid particles of a metals passivating additive comprising an alkaline earth metal oxide and an alkaline earth metal spinel which is brought into contact with the feedstock poor to the feedstock being brought into contact with the cracking catalyst.

8. A process according to claim 7 in which eh cracking zone comprises a cracking riser having an inlet for the feedstock, an inlet for the additive and an inlet for regenerated cracking catalyst, the feedstock inlet and the additive inlet being located at the base of the riser with the regenerated catalyst inlet located higher in the riser.

9. A process according to-claim 7 in which the separated additive particles are regenerated separately from the catalyst particles.

10. A process according to claim 7 in which the additive particles are separated from the catalyst particles after the catalyst particles have been separated from the cracking products in the disengaging zone by means of a physical separation.

11. A process according to claim 3 in which the size classification is carried out in a cyclone separator in the disengaging zone.

12. A process according to claim 11 in which the separated particles of the additive composition are oxidatively regenerated in a regeneration zone separate form the cracking catalyst regeneration zone to remove carbonaceous deposits, after which the regenerated additive particles are returned to the cracking zone to contact the feedstock.

13. A process according to claim 2 in which particles of the additive composition are separated from the cracking catalyst by density classification in a regeneration zone.

14. A process according to claim 13 in which the density classification is made in a dense fluidized bed regeneration zone to which eh particles of the additive composition and the cracking catalyst are admitted for concurrent regeneration while undergoing density classification with separate withdrawal of the additive composition and the cracking catalyst from the regeneration zone.

15. A process according to claim 2 in which the separated additive composition particles are contacted with a reducing gas to passivate metals deposited on the additive composition particles.

16. A process according to claim 7 in which the additive composition particles are contacted with a reducing gas to passivate metals deposited on the additive composition particles.

* * * * *